United States Patent [19]

Bronstein-Bonte

[11] Patent Number: 4,563,411

[45] Date of Patent: Jan. 7, 1986

[54] COPOLYMERIC MORDANTS AND PHOTOGRAPHIC PRODUCTS AND PROCESSES CONTAINING SAME

[75] Inventor: Irena Y. Bronstein-Bonte, Newton, Mass.

[73] Assignee: Polaroid Corporation, Cambridge, Mass.

[21] Appl. No.: 641,766

[22] Filed: Aug. 17, 1984

[51] Int. Cl.[4] ..... G03C 1/40; G03C 5/54

[52] U.S. Cl. ..... 430/213; 430/238; 430/941; 428/500; 428/522

[58] Field of Search ..... 430/213, 941, 238; 101/464; 428/500, 522; 526/259, 263, 265, 304, 307.3

[56] References Cited

U.S. PATENT DOCUMENTS

| | | | |
|---|---|---|---|
| 3,421,893 | 1/1969 | Taylor | 430/215 |
| 3,497,467 | 2/1970 | Coleman | 526/304 |
| 3,578,637 | 5/1971 | Coleman | 526/304 |
| 3,607,835 | 9/1971 | Paleologo et al. | 526/304 |
| 3,770,439 | 11/1973 | Taylor | 430/213 |
| 4,424,326 | 1/1984 | Land et al. | 430/213 |
| 4,463,080 | 7/1984 | Snow et al. | 430/213 |

*Primary Examiner*—Richard L. Schilling
*Attorney, Agent, or Firm*—Louis G. Xiarhos

[57] ABSTRACT

Copolymeric mordant materials containing recurring units according to the following formula are disclosed:

In such copolymers, each of $R^1$, $R^2$ and $R^3$ can independently be alkyl; substituted-alkyl; cycloalkyl; aryl; aralkyl; alkaryl; or at least two of $R^1$, $R^2$ and $R^3$, together with the quaternary nitrogen atom to which they are bonded, can complete a saturated or unsaturated, substituted or unsubstituted nitrogen-containing heterocyclic ring; X is an anion; each $R^4$ is alkyl of from 1 to 6 carbon atoms; $R^5$ is a divalent alkylene of from 1 to 8 carbon atoms; $R^6$ is hydrogen, amino, phenyl or alkyl of from 1 to 4 carbon atoms; $R^7$ is hydrogen or methyl; and m is an integer 1 or 2. The molar ratio of a:b can range from about 0.1:1 to about 10:1, e.g., about 0.3:1 to about 3:1.

The copolymeric mordant materials can be utilized as image-receiving layers in photographic products and processes of the diffusion transfer type. The mordants are especially adapted to the production of dye images exhibiting favorable maximum density ($D_{max}$) and rates of dye transfer properties.

40 Claims, 4 Drawing Figures

COPOLYMERIC MORDANTS AND PHOTOGRAPHIC PRODUCTS AND PROCESSES CONTAINING SAME

BACKGROUND OF THE INVENTION

This invention relates to copolymeric materials having dye mordanting capability. More particularly, it relates to mordant copolymers especially suited to application in photographic diffusion transfer products and processes.

Diffusion transfer photographic products and processes have been described in numerous patents, including, for example, U.S. Pat. Nos. 2,983,606; 3,345,163; 3,362,819; 3,594,164; and 3,594,165. In general, diffusion transfer photographic products and processes involve film units having a photosensitive system including at least one silver halide layer, usually integrated with an image-providing material, e.g., an image dye-providing material. After photoexposure, the photosensitive system is developed, generally by uniformly distributing an aqueous alkaline processing composition over the photoexposed element, to establish an imagewise distribution of a diffusible image-providing material. The image-providing material is selectively transferred, at least in part, by diffusion to an image-receiving layer or element positioned in a superposed relationship with the developed photosensitive element and capable of mordanting or otherwise fixing the image-providing material. The image-receiving layer retains the transferred image for viewing and in some diffusion transfer products, the image is viewed in the layer after separation from the photosensitive element, while in other products, such separation is not required.

Various polymeric materials have been utilized as mordants in photographic products and processes including those of the diffusion transfer type. Thus, polymeric mordants suited to application in diffusion transfer products and processes for the formation of photographic images in dye are described, for example, in U.S. Pat. No. 3,148,061 (issued Sept. 8, 1964 to H. D. Haas); U.S. Pat. No. 3,758,445 (issued Sept. 11, 1973 to H. L. Cohen et al.); U.S. Pat. No. 3,770,439 (issued Nov. 6, 1973 to L. D. Taylor): and in U.S. Pat. No. 4,080,346 (issued Mar. 31, 1978 to S. F. Bedell). The advantageous utilization of a particular mordanting material in a photographic product or process will oftentimes depend upon the particular requirements of a photographic product or process and deficiencies or disadvantages associated with the utilization of a particular mordanting material may be observed. Thus, deficiencies in mordanting capacity with respect to one or more dye materials desirably utilized in a photographic product may be observed. Accordingly, the provision of mordanting materials which exhibit favorable mordanting properties, especially favorable maximum density ($D_{max}$) values, is particularly desirable insofar as such properties permit the attainment of desired image formation and quality of photographic reproduction.

SUMMARY OF THE INVENTION

There is provided by the present invention a class of efficient mordanting polymers especially adapted to utilization in photographic products and processes of the diffusion transfer type. These polymeric mordants are copolymeric mordant materials containing recurring units according to the formula

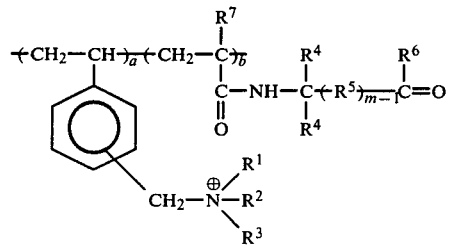

Formula I wherein each of $R^1$, $R^2$ and $R^3$ is independently alkyl (e.g., methyl, ethyl, propyl, butyl); substituted-alkyl (e.g., hydroxyethyl, hydroxypropyl); cycloalkyl (e.g., cyclohexyl); aryl (e.g., phenyl, naphthyl); aralkyl (e.g., benzyl); alkaryl (e.g., tolyl); or at least two of $R^1$, $R^2$ and $R^3$ together with the quaternary nitrogen atom to which they are bonded complete a saturated or unsaturated, substituted or unsubstituted nitrogen-containing heterocyclic ring (e.g., morpholino, piperidino or 1-pyridyl); X is a counteranion (e.g., halide); each $R^4$ is alkyl of from 1 to 6 carbon atoms (e.g., methyl, ethyl); $R^5$ is a divalent alkylene of from 1 to 8 carbon atoms (e.g., methylene); $R^6$ is hydrogen, amino, phenyl or alkyl of from 1 to 4 carbon atoms; $R^7$ is hydrogen or methyl; m is an integer 1 or 2; and wherein each of a and b is in integer and the molar ratio of a:b is from about 0.1:1 to about 10:1. From inspection of Formula I, it will be appreciated that the copolymeric mordants contain recurring units from an N-substituted acrylamide (where $R^7$ is hydrogen) or from an N-substituted methacrylamide (where $R^7$ is methyl). For convenience, such recurring units are referred to collectively as recurring units from an N-substituted (meth) acrylamide.

It has been found that copolymeric materials comprising recurring units from a vinylbenzyl quaternary ammonium salt and an N-substituted (meth)acrylamide, each as aforedescribed exhibit efficient mordanting capacity and are especially suited as mordants in photographic products and processes.

In a product or article aspect of the present invention, there is provided an image-receiving element comprising a support carrying an image-receiving layer comprising a copolymeric mordant as aforedescribed. In another of its product or article aspects, the present invention provides a diffusion transfer film unit which comprises a photosensitive system comprising at least one photosensitive silver halide emulsion layer having associated therewith a diffusion transfer process image dye-providing material and an image-receiving layer adapted to receive an image dye-providing material after photoexposure and processing, the image-receiving layer comprising a copolymeric mordant as aforedescribed.

In a process aspect of the present invention, there is provided a process for forming a diffusion transfer image which comprises the steps of exposing a photosensitive system comprising at least one photosensitive silver halide emulsion layer having associated therewith a diffusion transfer image dye-providing material; contacting the exposed photosensitive system with an aqueous alkaline processing composition, thereby effecting development of the silver halide emulsion (or emulsions) and the formation of an imagewise distribution of diffusible image dye-providing material; and transferring, by imbibition, at least a portion of the imagewise distribution of diffusible image dye-providing material to a superposed image-receiving layer comprising a copolymeric mordant as aforedescribed.

For a fuller understanding of the nature and objects of the invention, reference should be had to the following detailed description taken in connection with the accompanying drawings.

DETAILED DESCRIPTION OF THE INVENTION

Figure 1:
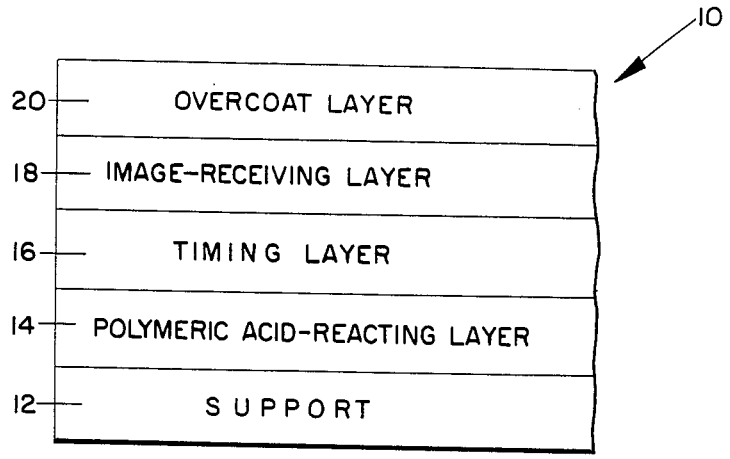
FIG. 1 is a diagrammatic cross-sectional view of an image-receiving element of the invention comprising a support material; a polymeric acid-reacting layer, a timing layer, an image-receiving layer of the invention and an overcoat layer.

As mentioned previously, the present invention is directed toward copolymeric mordant materials and to photographic elements, products and processes utilizing such copolymeric mordant materials. When utilized in the image-receiving layers of the photographic elements or products of this invention these copolymeric mordant materials function to fix or mordant diffusible dye image-providing materials. Thus, color images can be formed in image-receiving layers comprising the copolymeric mordants of the present invention by transferring to the image-receiving layer an imagewise distribution of diffusible image dye-providing material and utilizing the copolymeric mordant to fix and hold the transferred dye in the layer.

As can be appreciated from inspection of Formula I, the copolymeric mordants of the present invention comprise recurring units resulting from the polymerization of copolymerizable ethylenically-unsaturated comonomers. Thus, the copolymers comprise repeating or recurring units from a copolymerizable vinylbenzyl quaternary ammonium salt having the formula

FORMULA II

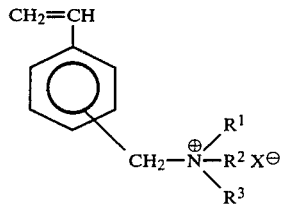

wherein each of $R^1$, $R^2$, $R^3$ and X have the meanings hereinbefore ascribed.

The nature of the quaternary nitrogen groups of the compounds of Formula II and of the recurring units of the copolymeric mordants of the invention can vary with the nature of the $R^1$, $R^2$ and $R^3$ groups thereof. Thus, the $R^1$, $R^2$ and $R^3$ substituents on the quaternary nitrogen atom of the compounds of Formula II, and present in the recurring units of the copolymeric mordants hereof, can each be alkyl (e.g., methyl, ethyl, propyl, butyl); substituted-alkyl (e.g., hydroxyethyl, hydroxypropyl); cycloalkyl (e.g., cyclohexyl); aryl (e.g., phenyl, napthyl); aralkyl (e.g., benzyl); or alkaryl (e.g., tolyl). Preferred $R^1$, $R^2$ and $R^3$ groups include alkyl, such as alkyl groups of from 1 to about 8 carbon atoms; cyclohexyl; and benzyl. Especially preferred compounds represented by Formula II and providing recurring units of the copolymeric mordants hereof are those wherein each of $R^1$, $R^2$ and $R^3$ is the same alkyl group such as methyl. Other preferred compounds herein are those, for example, wherein $R^1$ and $R^2$ are each alkyl, e.g., methyl, and $R^3$ is cyclohexyl.

As indicated previously, the groups $R^1$, $R^2$ and $R^3$ of the compounds of Formula II, and of the corresponding recurring units of the copolymeric mordants hereof, can complete with the quaternary nitrogen atom a nitrogen-containing heterocyclic ring. The nitrogen-containing heterocyclic ring can comprise a saturated or unsaturated ring and, additionally, can be a substituted or unsubstituted heterocyclic ring. It will be appreciated that the formation of a saturated N-containing heterocyclic ring will involve two of the $R^1$, $R^2$ and $R^3$ groups while in the formation of an unsaturated nitrogen-containing heterocyclic ring such as 1-pyridyl, each of groups $R^1$, $R^2$ and $R^3$ will be involved. Other examples of suitable nitrogen-containing heterocyclic groups formed with the quaternary nitrogen atom include morpholino and piperidino.

The particular nature of the $R^1$, $R^2$ and $R^3$ substituents of the compounds of Formula II and of the copolymeric mordants hereof will depend upon the particular mordanting capability desired in the copolymeric mordant and upon any influence of such substituent groups on such properties of the copolymeric mordants as solubility, swellability or coatability. The $R^1$, $R^2$ and $R^3$ groups of a recurring unit of the copolymeric mordants hereof can, as indicated, be the same or different to suit particular applications. Similarly, copolymeric mordants comprising recurring units from two or more compounds represented by the structure of Formula II are also contemplated herein. Such copolymeric mordants may comprise recurring units from each of differently substituted compounds exhibiting differences in mordanting capability or affinity to dyes or variously affecting desired properties of the copolymeric mordants. It will be appreciated that copolymeric mordants of this type can be prepared by the polymerization of an N-substituted (meth)acrylamide as aforedescribed with a mixture of two or more dissimilar ethylenically-unsaturated copolymerizable compounds represented by the structure of Formula II, i.e., a mixture of compounds wherein the $R^1$, $R^2$ and $R^3$ substitution of the respective compounds is different.

The moiety X shown in the compounds represented by structure of Formula II, and in the copolymeric mordants represented by the structure of Formula I, is an anion such as halide (e.g., bromide or chloride). Other anionic moieties representative of anion X include sulfate, alkyl sulfate, alkanesulfonate, arylsulfonate (e.g., p-toluenesulfonate), acetate, phosphate, dialkyl phosphate or the like. A preferred anion is chloride.

Suitable examples of ethylenically-unsaturated monomers representative of compounds of Formula II useful in the preparation of copolymeric mordants of the present invention are vinylbenzyl trimethyl ammonium chloride; vinylbenzyl trihexyl ammonium chloride; vinylbenzyl dimethylcyclohexyl ammonium chloride; vinylbenzyl dimethylbenzyl ammonium chloride; vinylbenzyl triethyl ammonium chloride; vinylbenzyl pyridinium chloride. Mixtures comprising positional isomers can be employed. A preferred vinylbenzyl quaternary salt comprises a mixture of positional isomers (para and meta) of vinylbenzyl trimethyl ammonium chloride.

Representative structures of recurring units of the copolymeric mordants of the present invention include:

FORMULA IIa

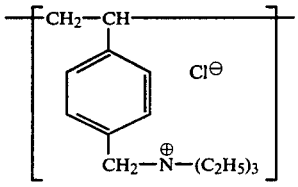

FORMULA IIb

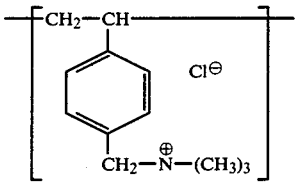

FORMULA IIc

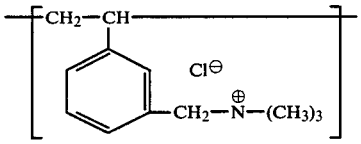

FORMULA IId

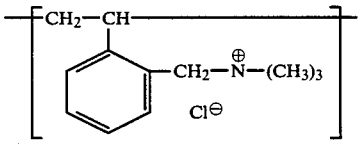

FORMULA IIe

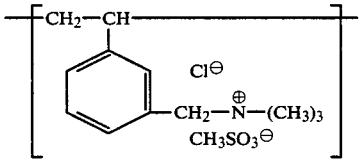

It will also be appreciated from inspection of Formula I that the copolymeric mordants of the present invention include repeating or recurring units resulting from the polymerization of an N-substituted (meth)acrylamide having the formula Formula III

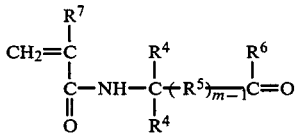

wherein each of $R^4$, $R^5$, $R^6$, $R^7$ and m have the meanings hereinbefore ascribed. The nature of the N-substituency will depend upon the particular nature of each of $R^4$, $R^5$, $R^6$ and the integer m.

Each $R^4$ group can be the same or different alkyl group of from 1 to 6 carbon atoms. Preferably, each $R^4$ will be the same and will be methyl or ethyl. Divalent radical $R^5$ is a divalent alkylene radical having from 1 to 8 carbon atoms and can be either straight- or branch-chained. Preferably, $R^5$ will be methylene. $R^6$ can be hydrogen, amino, phenyl or alkyl of from 1 to 4 carbon atoms, and preferably, will be alkyl, e.g., methyl. $R^7$ can be hydrogen or methyl, and preferably, will be hydrogen. It will be understood that where m is 1, the $R^5$ alkylene radical will not be present. Preferably, m will be the integer 2.

A preferred copolymerizable N-substituted acrylamide is the N-3-oxoalkyl-substituted acrylamide according to the formula:

Formula IIIa

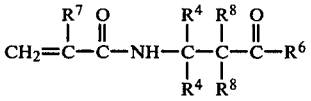

wherein each of $R^4$, $R^6$, and $R^7$ have the meanings aforedescribed and each $R^8$ is hydrogen, methyl or ethyl. Preferably, each $R^4$ will be methyl, $R^6$ will be alkyl of from 1 to 4 carbon atoms, $R^7$ will be hydrogen, and each $R^8$ will be hydrogen. Especially preferred is the N-oxoalkyl-substituted acrylamide wherein each $R^4$ is methyl, $R^7$ is hydrogen, each $R^8$ is hydrogen and $R^6$ is methyl and such monomer may be alternatively referred to as diacetone acrylamide (DAA). Mixtures of polymerizable monomers from the class represented by Formula III can be employed.

The ratio of recurring units in the copolymeric mordants hereof, represented by integers a and b in the polymers of Formula I, can vary widely. The molar ratio of recurring units from a vinylbenzyl quaternary ammonium salt to recurring units from an N-substituted (meth)acrylamide, i.e., the ratio of a:b, will normally vary within the range of from about 0.1:1 to about 10:1. In general, the ratio of recurring units from the vinylbenzyl quaternary ammonium salt to recurring units from the N-substituted (meth)acrylamide should be such as to provide a requisite number of quaternary ammonium mordant sites for the mordanting of an image-providing material, e.g., an image dye-providing material. Similarly, the ratio should be such as to provide a sufficient number of recurring units from the N-substituted (meth)acrylamide as to enhance the mordanting capability of the quaternary ammonium mordanting sites without introduction of unacceptable hydrophobicity and reduction in obtainable dye densities. A preferred ratio of recurring units from the vinylbenzyl quaternary ammonium salt and from the N-substituted (meth)acrylamide, i.e., the molar ratio of a:b, is from about 0.3:1 to about 3:1. Such a copolymeric mordant can be conveniently coated in the formation of an image-receiving layer providing the mordanting sites for efficient dye mordanting without excessive coating or coverage requirements. Good results are provided, for example, from a 1:1 mole ratio copolymer.

It will be appreciated that within the aforesaid molar proportions, changes in relative molar proportions of the respective recurring units will influence the physical and functional properties of the copolymeric mordants. Thus, differences in alkali solubility or swellability, alkali permeability, hydrophilic-hydrophobic balance, coatability of the copolymeric mordant or receptivity of the copolymeric mordant to one or more dyes may be observed. Variations in molar ratios can, accordingly, be made in the interests of maximizing mordanting properties or adjusting mordanting properties to suit particular desires or requirements or to adapt the copolymeric mordant to efficient utilization in a particular photographic product or system.

The copolymeric mordants of the present invention can be prepared by the polymerization in suitable proportions of the vinylbenzyl quaternary ammonium salt and N-substituted (meth)acrylamide monomers set forth hereinbefore. The polymerization can be conducted by resort to bulk, solution, suspension or emulsion techniques. The polymerization can be initiated chemically, as by the utilization of a suitable free-radical polymerization initiator or redox initiator. Suitable free-radical initiators include the water-soluble or alcohol-soluble azo-type initiators such as 4,4'-azobis-4(cyanovaleric acid), azobisisobutyronitrile, diazoaminobenzene and 2,2'-azobis(2-amidinopropane) hydrochloride. Suitable redox-type polymerization initiators include a combination of a reducing agent such as sodium bisulfite, ascorbic acid or a ferrous salt and an oxidizing agent such as benzoyl peroxide, ammonium persulfate, hydrogen peroxide, diacetyl peroxide, t-butyl hydroperoxide or an alkali metal persulfate. The amount of catalyst employed can be varied to suit particular needs. In general, satisfactory polymerization reactions can be conducted over a temperature range of from about 25° C. to about 100° C. utilizing less than about 5% by weight of the initiator, based upon the weight of the copolymerizable monomers.

The copolymeric mordant materials of the present invention can be utilized for the provision of an image-receiving layer for photographic images in dye, and in particular, for the provision of multicolor dye images. The copolymeric mordant material of the invention can alone comprise the image-receiving layer or can be employed in admixture with other polymeric materials to comprise an image-receiving layer. Particularly preferred is an image-receiving layer comprising a mixture or blend of a copolymeric mordant material of the invention, as hereinbefore described, with other known polymeric image-receiving layer materials, particularly hydrophilic polymeric materials such as gelatin, polyvinylalcohol, polyvinylpyrrolidones, and mixtures of these. The materials utilized in admixture with the copolymeric mordant material hereof and the relative amounts of each can depend, for example, on the nature and amount of dye desirably mordanted and upon the permeability of the image receiving layer to an aqueous alkaline processing composition. Particularly preferred image-receiving layers comprise a mixture of the copolymeric mordant hereof and polyvinylpyrrolidone where the ratio by weight of polyvinylpyrrolidone to the copolymeric mordant hereof is about 0.3:1 to about 3:1. For example, good results are realized using a 1/1 weight ratio of copolymeric mordant and a low molecular weight polyvinylpyrrolidone such as "PVP K-30" (polyvinylpyrrolidone have a molecular weight of about 15,000 and commercially available from GAF Corporation).

Image-receiving layers comprising the copolymeric mordants of this invention can be utilized, for example, in image-receiving elements designed to receive and mordant image dye-providing materials. Such image-receiving elements will generally comprise a suitable support carrying an image-receiving layer comprising a copolymeric mordant of this invention and may also include one or more polymeric acid-reacting layers such as those described, for example, in U.S. Pat. No. 3,362,819. These polymeric acids can be polymers which contain acid groups, e.g., carboxylic acid and sulfonic acid groups, which are capable of forming salts with alkali metals or with organic bases; or potentially acid-yielding groups such as anhydrides or lactones. The polymeric acid-reacting layer functions to reduce the environmental pH of a diffusion transfer system in which the image-receiving layer is utilized and, thereby, provides the advantages and benefits thereof known in the art.

A spacer layer may be disposed between the polymeric acid layer and the image-receiving layer in order to control the pH reduction so that it is not premature, e.g., to "time" control the pH reduction. Suitable spacer of "timing" layers for this purpose are described, for example, in U.S. Pat. Nos. 3,362,819; 3,419,398; 3,431,893; 3,433,633; 3,455,686; 3,575,701; and 3,756,815.

Referring to FIG. 1, there is shown an image-receiving element of the invention 10 comprising support material 12 carrying a layer of acid-reacting polymer 14, a timing layer 16, and image-receiving layer 18 comprising a copolymeric mordant of the invention and optional overcoat layer 20. Support material 12 can comprise any of a variety of materials capable of carrying image-receiving layer 18 and other layers as shown in FIG. 1. Paper, vinyl chloride polymers, polyamides such as nylon, polyesters such as polyethylene glycol terephthalate or cellulosic derivatives such as cellulose acetate or cellulose acetate-butyrate can be suitably employed. It will be appreciated that depending upon the particular application intended for image-receiving element 10, the nature of support material 12 as a transparent, opaque or translucent material will be a matter of choice.

According to one embodiment of the present invention, image-receiving element 10 can comprise support material 12 on which is present image-receiving layer 18. Polymeric acid-reacting layer 14 and timing layer 16, each shown in FIG. 1, need not be present in image-receiving element 10, and where such an image-receiving element is utilized in a photographic diffusion transfer product or process, polymeric acid-reacting and timing layers 14 and 16, respectively, can be otherwise suitably positioned in such product or process as will be apparent from the film unit of FIG. 3, described in greater detail hereinafter. According to one embodiment, image-receiving element 10 will include polymeric acid-reacting and timing layers, shown, respectively, in FIG. 1 as layers 14 and 16. The nature and function of such layers in diffusion transfer products and processes is known and described in greater detail hereinafter.

As indicated previously, support 12 of image-receiving element or article 10 can be suitably transparent, opaque or translucent depending upon a particular application of the element or article. Thus, where image-receiving element 10 is desirably utilized in the manufacture of photographic diffusion transfer film units such as shown generally in FIGS. 2 and 3 hereof, where the desired image will be viewed through a support, support 12 will be of transparent material. A preferred material for this purpose is a polyethylene glycol terephthalate sheet-like support material. Alternatively, where image-receiving element 10 is utilized in the manufacture of a photographic film unit such as is generally shown in FIG. 4, where the desired image will be viewed as a reflection print against a light-reflecting layer, support material 12 will preferably be of opaque material.

In FIG. 1 is shown overcoat layer 20 which comprises an optional layer of image-receiving element 10. Image-receiving layer 18 can, thus, comprise the outermost layer of image-receiving element 10. In some instances, it may be desirable to provide such image-receiving layer 18 with a washing treatment, as by washing the layer with ammonia. The washing treatment can be conveniently effected with ammonia or a solution of ammonium hydroxide in a concentration, preferably of from about 2% to about 8% by weight. Such ammonia washing treatment effectively neutralizes residual acrolein/formaldehyde condensate where such material is utilized for the hardening of the image-receiving layer and the provision of reduced water sensitivity. According to one embodiment of the invention, as shown in FIG. 1, an overcoat layer 20 can be present on image-receiving layer 18. Such overcoat layer can be comprised of a polymeric material such as polyvinyl alcohol.

Overcoat layer 20 can also be utilized as a means of facilitating separation of image-receiving element 10 from a photosensitive element. Thus, where the image-receiving element is utilized in a photographic film unit which is processed by distribution of an aqueous alkaline processing composition between the image-receiving element and a photoexposed photosensitive element and is adapted, after formation of a dye image, to separation from the developed photosensitive element and the processing composition, overcoat layer 20 can effectively function as a "strip coat".

An overcoat suited as a "strip coat" can be prepared from a variety of hydrophilic colloid materials. Suitable hydrophilic colloids for an overcoat or "strip coat" for a diffusion transfer image-receiving element requiring separation, subsequent to formation of a transfer image from a processing composition, include gum arabic, carboxymethyl cellulose, hydroxyethyl cellulose, carboxymethyl hydroxyethyl cellulose, cellulose acetate-hydrogen phthalate, polyvinyl alcohol, polyvinyl pyrrolidone, methyl cellulose, ethyl cellulose, cellulose nitrate, sodium alginate, pectin, polymethacrylic acid, polymerized salts of alkyl, aryl and alkyl sulfonic acids (e.g., Daxad, W.R. Grace Co.), and the like.

Overcoat 20 can comprise a solution of hydrophilic colloid and ammonia and can be coated from an aqueous coating solution prepared by diluting concentrated ammonium hydroxide (about 28.7% $NH_3$) with water to the desired concentration, preferably from about 2% to about 8% by weight, and then adding to this solution an aqueous hydrophilic colloid solution having a total solids concentration in the range of about 1% to about 5% by weight. The coating solution also preferably may include a small amount of a surfactant, for example, less than about 0.10% by weight of Triton X-100 (Rohm and Haas, Co., Phila., Pa.). A preferred solution comprises about 3 parts by weight of ammonium hydroxide and about 2 parts by weight of gum arabic.

The image-receiving layers of the present invention find applicability in a number of photographic diffusion transfer products and processes. According to one embodiment of the present invention, the image-receiving layers of the invention are utilized in photographic film units adapted to the provision of photographs comprising the developed silver halide emulsion(s) retained as part of a permanent laminate, with the desired image being viewed through a transparent support against a reflecting background. In such photographs, the image-carrying layer is not separated from the developed silver halide emulsion(s). Diffusion transfer photographic products providing an image viewable without separation against a reflecting background in such a laminate have been referred to in the art as "integral negative-positive film units".

Integral negative-positive film units of a first type are described, for example, in the above-noted U.S. Pat. No. 3,415,644 and include appropriate photosensitive layer(s) and image-dye-providing materials carried on an opaque support, an image-receiving layer carried on a transparent support and means for distributing a processing composition between the elements of the film unit. Photoexposure is made through the transparent support carrying a polymeric acid-reacting layer, a timing layer and the image-receiving layer of the invention. A processing composition containing a reflecting pigment is distributed between the image-receiving and photosensitive components. After distribution of the processing composition and before processing is complete, the film unit can be, and usually is, transported into light. Accordingly, in integral negative-positive film units of this type, the layer provided by distributing the reflecting pigment provides a reflecting background for viewing through the transparent support the image transferred to the image-receiving layer.

Integral negative-positive film units of a second type, as described, for example, in U.S. Pat. No. 3,594,165, include a transparent support, carrying the appropriate photosensitive layers and associated image dye-providing materials, a permeable opaque layer, a permeable and preformed light-reflecting layer, and means for distributing a processing composition between the photosensitive layer and a transparent cover or spreader sheet carrying a polymeric acid-reacting layer and a timing layer. Integral negative-positive film units of this second type include an opaque processing composition which is distributed after photoexposure to provide a second opaque layer which can prevent additional exposure of the photosensitive element. In film units of this second type, exposure is made through the transparent cover or spreader sheet. The desired transfer image is viewed against the reflecting pigment-containing layer through the transparent support element.

The arrangement and order of the individual layers of the diffusion transfer film units described herein may vary in many ways as is known in the art, provided the film units comprise an image-receiving layer comprising a copolymeric mordant of the invention. For convenience, however, the more specific descriptions of the invention hereinafter set forth will be by use of dye developer diffusion transfer color processes and of diffusion transfer film units of the type generally contemplated in previously mentioned patents. Thus, details relating to integral negative-positive film units of the first type described hereinbefore can be found in such patents as U.S. Pat. Nos. 3,415,644 and 3,647,437 while details of the second type are found in U.S. Pat. No. 3,594,165. It will be readily apparent from such descriptions that other image-forming reagents may be used, e.g., color couplers, coupling dyes, or compounds which release a diffusible dye or dye intermediate as a result of coupling or oxidation.

Figure 2:
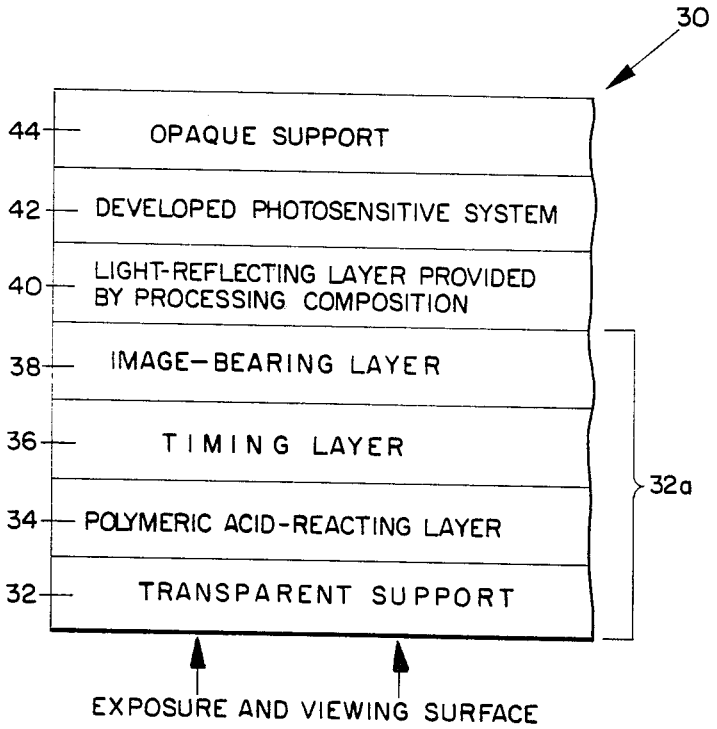

Referring now to the drawings, FIG. 2 shows a film unit of the type described in referenced U.S. Pat. Nos. 3,415,644 and 3,657,437, following exposure and processing. The film unit 30 includes a polymeric acid-reacting layer 34, timing layer 36 and image-receiving layer 38 comprising a mordant copolymer of the invention. After photoexposure of photosensitive layer(s) 42 (through transparent support 32, polymeric acid-reacting layer 34, timing layer 36 and image-receiving layer 38) the processing composition retained in a rupturable container (not shown) is distributed between layers 38 and 42. Processing compositions used in such film units of the present invention are aqueous alkaline photographic processing compositions comprising a reflecting pigment, usually titanium dioxide, and a polymeric film-forming agent and will preferably contain an optical filter agent described in detail in U.S. Pat. No. 3,647,437.

Distribution of the processing composition over photoexposed portions of photosensitive system 42 provides a light-reflecting layer 40 between image-receiving layer 38 and photosensitive layer(s) 42. This layer, at least during processing, provides sufficient opacity to protect photosensitive system 42 from further photoexposure through transparent support 32. As reflective layer 40 is installed, by application of the processing composition, development of photoexposed photosensitive layer(s) 42 is initiated to establish in manners well-known in the art an imagewise distribution of diffusible image-providing material which can comprise soluble silver complex or one or more dye or dye intermediate image-providing materials. The diffusible image-providing material is transferred through permeable, light-reflecting layer 40 where it is mordanted, precipitated or otherwise retained in or on image-receiving layer 38 of the invention. The resulting transfer image is viewed through transparent support 32 against light-reflecting layer 40.

The light-reflecting layer 40 provided by the embodiment of the invention shown in FIG. 2 is formed by solidification of the stratum of processing composition distributed after exposure. The processing composition will include the film-forming polymer which provides the polymeric binder matrix for the light-reflecting pigment of layer 40. Absorption of water from the applied layer of processing composition results in a solidified film comprising the polymeric binder matrix and the pigment material, thus providing the light-reflecting layer 40 which permits the viewing thereagainst of image 38 through transparent support 32. In addition, light-reflecting layer 40 serves to laminate together the developed photosensitive system 42 and the image-bearing layer 38 to provide the final photographic laminate.

Figure 3:
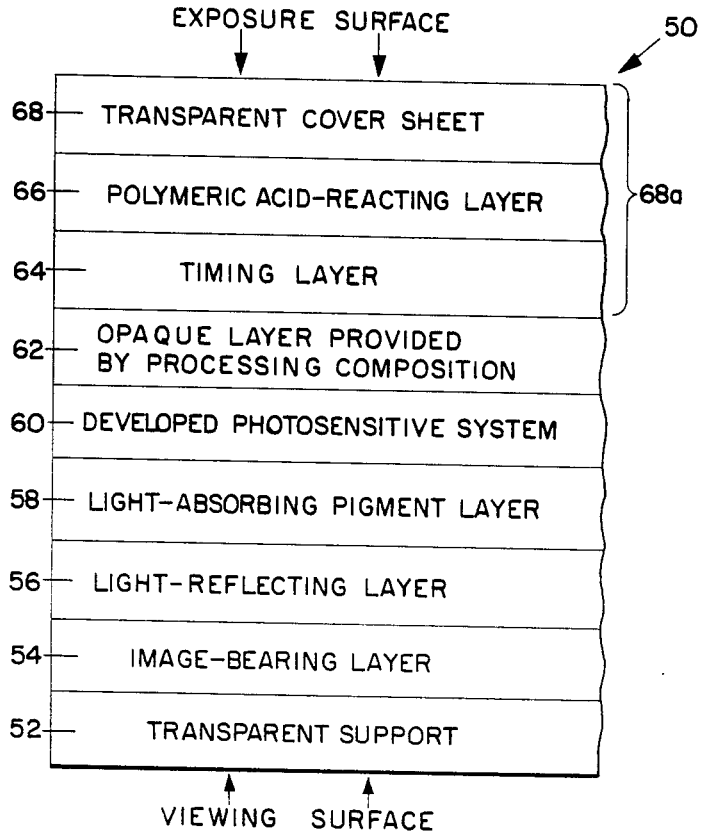
Figure 4:
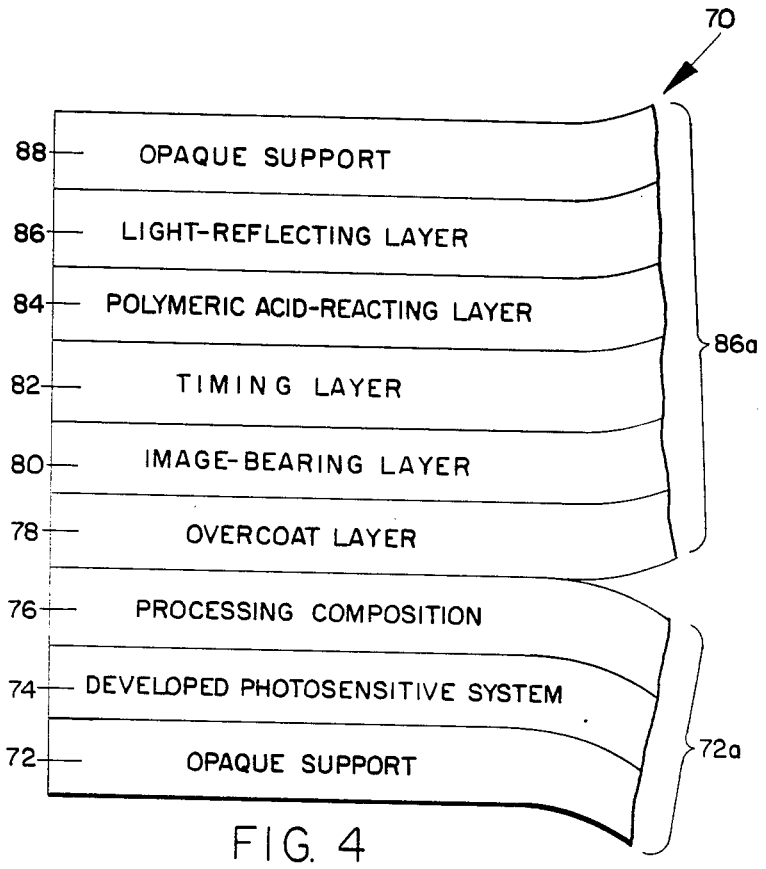

In each of articles 10 and 30, respectively, of FIGS. 1 and 2, and in articles 50 and 70, respectively, of FIGS. 3 and 4, is shown a polymeric acid-reacting layer. In each instance, the polymeric acid-reacting layer, e.g., layer 14 of image-receiving element 10, provides important functions in photographic processing. The processing compositions typically employed in diffusion transfer processes of the type contemplated herein will generally comprise an aqueous alkaline composition having a pH in excess of about 12, and frequently in the order of 14 or greater. The liquid processing composition permeates the emulsion layer(s) of the photosensitive element to effect development thereof. The elevated environmental pH conditions of the film unit upon spreading or distribution of the alkaline processing composition are conducive to the transfer of image dyes. The acid-reacting layer, for example, polymeric acid-reacting layer 14 of image-receiving element 10 or polymeric acidrescting layer 34 of film unit 30, is, thus, employed to lower in predetermined manner the environmental pH of the film unit following substantial dye transfer in order to increase image stability and/or adjust the pH from a first pH at which the image dyes are diffusible to a second and lower pH at which such image-dyes are not diffusible. Simultaneously, the reduction of pH permits decolorization of opacification dyes utilized in the film unit to provide inlight development capability.

As disclosed in, for example, U.S. Pat. 3,362,819, the polymeric acid-reacting layer may comprise a nondiffusible acid-reacting reagent adapted to lower the pH from the first (high) pH of the processing composition in which the image dyes are diffusible to a second (lower) pH at which they are not. The acid-reacting reagents are preferably polymers which contain acid groups, e.g., carboxylic acid and sulfonic acid groups, which are capable of forming salts with alkali metals or with organic bases; or potentially acid-yielding groups such as anhydrides or lactones. Preferably, the acid polymer contains free carboxyl groups. As examples of useful neutralizing layers, in addition to those disclosed in the aforementioned U.S. Pat. No. 3,362,819, mention may be made of those disclosed in the following U.S. Patents: Bedell, U.S. Pat. No. 3,765,885; Sahatjian, et al., U.S. Pat. No. 3,819,371; Haas, U.S. Pat. No. 3,833,367; Taylor U.S. Pat. No. 3,754,910 and Schlein, U.S. Pat. No. 3,756,815.

In each of the articles shown in FIGS. 1 to 4 is shown a timing layer which is included for the control of the pH-reducing properties of the polymeric acid-reacting layer. Thus, there is shown in FIG. 2 timing layer 36 positioned between polymeric acid-reacting layer 34 and image-receiving layer 38 of the invention. The spacer layer will be comprised of polyvinyl alcohol, gelatin or other polymer through which the alkali may diffuse to the polymeric acid-reacting layer. The presence of such a timing layer between the image-receiving layer 38 and the acid-reacting layer 34 effectively controls the initiation and the rate of capture of alkali by the acid-reacting layer. Suitable materials for the formation of timing layers and the advantages thereof in diffusion transfer systems are described with particularity in U.S. Pat. Nos. 3,362,819; 3,419,389; 3,421,893; 3,455,686; 3,577,237; and 3,575,701.

In the film unit shown in FIG. 2, polymeric acid-reacting layer 34 and the timing layer 36 are shown on transparent support 32. If desired, layers 34 and 36 can be positioned between opaque support 44 and photosensitive layer(s) 42. Thus, polymeric acid-reacting layer 34 can be positioned on opaque support 44 and timing layer 36 can be positined on the polymeric acid-reacting layer. In turn, the emulsion layer(s) comprising photosensitive system 42 can be positioned on the timing layer. In this case, image-receiving element **32*a* will comprise transparent support 32, and directly thereon, image-receiving layer 38**. The utilization of polymeric acid-reacting and timing layers in a photosensitive element as aforedescribed is described in U.S. Pat. Nos. 3,362,821 and 3,573,043.

In accordance with one embodiment of the invention, a photographic film unit can comprise a temporary laminate including the several layers of the photographic film unit confined between two dimensionally stable supports and having the bond between a predetermined pair of layers being weaker than the bond between other pairs of layers. Thus, with reference to FIG. 2, an image-receiving element **32*a*, comprising transparent support 32, polymeric acid-reacting layer 34, timing layer 36 and image-receiving layer 38 and corresponding generally to image-receiving element 10 of FIG. 1, can be arranged in article 30 such that image-receiving layer 38 is temporarily bonded to the silver halide emulsion layer 42 prior to exposure. The rupturable container or pod (not shown) can then be positioned such that, upon its rupture, the processing composition will delaminate the temporary bond and be distributed between the aforesaid layers 38 and 42. The distributed layer of processing composition upon drying forms light-reflecting layer 40** which serves to bond the layers together to form the desired permanent laminate. Procedures for forming such prelaminated film units, i.e., film units in which the several elements are temporarily laminated together prior to exposure, are described, for example, in U.S. Pat. No. 3,652,281, issued to Albert J. Bachelder and Frederick J. Binda and in U.S. Pat. No. 3,652,282 to Edwin H. Land both issued Mar. 28, 1972. A particularly useful and preferred prelamination utilizes a water-soluble polyethylene glycol as described and claimed in U.S. Pat. No. 3,793,023, issued Feb. 19, 1974 to Edwin H. Land.

If desired, the film unit shown in FIG. 2 may utilize a transparent support instead of the opaque support 44 shown therein. In accordance with this alternative embodiment, an opaque layer, e.g., pressure-sensitive, should be superposed over said transparent support to avoid further exposure through the back of the film unit during processing outside of the camera. In the embodiment illustrated in FIG. 2, photoexposure is effected through the image-receiving element. While this is a particularly useful and preferred embodiment, it will be understood that the image-receiving element may be initially positioned out of the exposure path and superposed upon the photosensitive element after photoexposure, in which event the processing and final image stages would be the same as in FIG. 2.

In FIG. 3 is shown, following exposure and processing, a second integral negative-positive type of diffusion transfer film unit of the invention utilizing an arrangement of elements generally described in U.S. Pat. No. 3,594,165 and British Pat. No. 1,330,524. Such arrangement provides an integral negative-positive reflection print and photoexposure and viewing are effected from opposite sides. Film unit 50 includes a processing composition initially retained in a rupturable container (not shown) arranged to distribute the processing composition between photosensitive system or layer 60 and a cover or spreader sheet 68*a* comprising a transparent sheet material 68, polymeric acid-reacting layer 66 and timing layer 64. Spreader sheet 68*a* facilitates uniform distribution of processing composition after photoexposure of photosensitive system or layer 60 which is effected through transparent sheet material 68. Processing compositions used in such film units are aqueous, alkaline photographic processing compositions which include a light-absorbing opacifying agent, e.g., carbon black.

Distribution of the processing composition between photoexposed photosensitive system or layer 64 and spreader sheet 68*a* installs an opaque layer 62 which protects system or layer 60 from further photoexposure through transparent spreader sheet 68*a*. Like the film units of FIG. 3, as and after opaque layer 62 is installed, the processing composition initiates development of photoexposed photosensitive system or layer 60 to establish an imagewise distribution of diffusible image-providing material in manners well-known to the art. For example, the processing composition may contain developing agents sufficient to effect photographic development. Alternatively, developing agents may be prsent in one or more layers of the film unit si that they may be carried to system or layer 60 by the processing composition. The diffusible imagewise distribution is transferred to image-receiving layer 54 through permeable light-reflecting layer 56 which comprises a preformed layer including a light-reflecting pigment. Film units of the type shown in FIG. 3 may also comprise a preformed and permeable opaque layer 58 including a light-absorbing pigment, e.g., a dispersion of carbon black in a polymer permeable to the processing composition. Such layer, between photosensitive system or layer 60 and light-reflecting layer 56, permits in-light development of film unit 50, providing opacification for the protection of photoexposed photosensitive system or layer 60 against further exposure through transparent support 52 and layers 54 and 56. The transfer image is viewed through transparent support 52 against light-reflecting layer 56.

The image-receiving layers of the present invention can be utilized in so-called "peel-apart" diffusion transfer film units designed to be separated after processing. Such a diffusion transfer film unit of the invention is shown in FIG. 4 as film unit 70. The film unit shown in FIG. 4 comprises a photosensitive elelemt 72*a* comprising an opaque support 72 carrying a photosensitive layer or system 74. In film units of this type, the photosensitive layer or system 74 is photoexposed and a processing composition 76 is then distributed over the photoexposed layer or system. An image-receiving element 86*a*, corresponding generally to image-receiving element 10 of FIG. 1, is superposed on the photoexposed photosensitive element. As shown in FIG. 4, image-receiving element 86*a* comprises an opaque support material 88, and a light-reflecting layer 86, against which the desired transfer image is viewed and which typically will comprise a polymeric matrix containing a suitable white pigment material, e.g., titanium dioxide. A polymeric acid-reacting layer 84 is shown positioned on light-reflecting layer 86 on which is shown timing layer 82, the image-receiving layer 80 of the invention and, in turn, overcoat layer 78, each of which layers is comprised of materials described hereinbefore in connection with the articles and film units shown in FIGS. 1 to 3. Like the film units shown in FIGS. 2 and 3, the processing composition permeates photoexposed photosensitive layer or system 74 to provide an imagewise distribution of diffusible dye image-providing material which is transferred at least in part to image-receiving layer 78. Unlike the film units of FIGS. 2 and 3, however, the transferred dye image is viewed in image-bearing layer 80 against light-reflecting layer 86 after separation of image-receiving element 86*a* from photosensitive element 72*a*.

While support material 88 of image-receiving element 86*a* is shown as being of opaque material, it will be appreciated that a transparent support material can be employed and that the film unit can be processed in the dark or an opaque sheet (not shown), preferably pressure-sensitive, can be applied over such transparent support to permit inlight development. In accordance with a preferred embodiment of the invention, whereby a reflection print is provided upon separation of image-receiving element 86*a* from photosensitive element 72*a*, opaque support 88 and light-reflecting layer 86 will comprise, for example, a suitable paper support, coated, preferably on both sides, with a polymeric coating, e.g., polyethylene, pigmented with titanium dioxide. Such a support material can be suitably provided with polymeric acid-reacting layer 84, a timing layer 82, an image-receiving layer 80 of the invention and optional overcoat layer 78, as shown in FIG. 4 with formation of image-receiving element 86*a*.

It will be appreciated that, where a transparency is desirably provided from film unit 70 of FIG. 4, support 88 can be transparent and light-reflecting layer 86 omitted. The desired image in image-bearing layer 80 can then, upon separation of image-receiving element 86*a* from photosensitive element 72*a*, be viewed as a positive transparency through transparent support material 88.

The film units illustrated in FIGS. 2 to 4 have, for convenience, been shown as monochrome films. Multicolor images may be obtained by providing the requisite number of differentially exposable silver halide emulsions, and said silver halide emulsions are most commonly provided as individual layers coated in superposed relationship. Film units intended to provide multicolor images comprise two or more selectively sensitized silver halide layers each having associated therewith an appropriate image dye-providing material providing an image dye having spectral absorption characteristics substantially complementary to the light by which the associated silver halide is exposed. The most commonly employed negative components for forming multicolor images are of the "tripack" structure and contain blue-, green-, and red-sensitive silver halide layers each having associated therewith in the same or in a contiguous layer a yellow, a magenta and a cyan image dye-providing material, respectively. Interlayers or spacer layers may, if desired, be provided between the respective silver halide layers and associated image dye-providing materials or between other layers. Integral multicolor photosensitive elements of this general type are disclosed in U.S. Pat. No. 3,345,163 issued Oct. 3, 1967, to Edwin H. Land and Howard G. Rogers, as well as in the previously noted U.S. patents, e.g., in FIG. 9 of the aforementioned U.S. Pat. No. 2,983,606.

The image dye-providing materials which may be employed in such processes generally may be characterized as either (1) initially soluble or diffusible in the processing composition, but are selectively rendered non-diffusible in an imagewise pattern as a function of development; or (2) initially insoluble or non-diffusible in the processing composition, but which are selectively rendered diffusible or provide a diffusible product in an imagewise pattern as a function of development. These materials may be complete dyes or dye intermediates, e.g., color couplers. The requisite differential in mobility or solubility may, for example, be obtained by a chemical action such as a redox reaction or a coupling reaction.

As examples of initially soluble or diffusible materials and their application in color diffusion transfer, mention may be made of those disclosed, for example, in U.S. Pat. Nos. 2,774,668; 2,968,554; 2,983,606; 2,087,817; 3,185,567; 3,230,082; 3,345,163; and 3,443,943. As examples of initially non-diffusible materials and their use in color transfer systems, mention may be made of the materials and systems disclosed in U.S. Pat. Nos. 3,185,567; 3,443,939; 3,443,940; 3,227,550; and 3,227,552. Both types of image dye-providing substances and film units useful therewith also are discussed in U.S. Pat. No. 3,647,437 to which reference may be made.

The image-receiving layers of the invention, as indicated hereinbefore, provide certain advantages in photographic diffusion transfer products and processes. Thus, an image-receiving element of the invention comprising a mordant copolymer hereof permits the realization of high maximum dye densities. It has been found, for example, that a 1:1 mole ratio copolymer of vinylbenzyl trimethyl ammonium chloride and diacetone acrylamide provides a higher level of maximum density ($D_{max}$) values than a homopolymer of vinylbenzyl trimethyl ammonium chloride. Surprisingly, the introduction into the homopolymer of recurring units from diacetone acrylamide, such as to provide a copolymer mordant of the invention, is accompanied by an increase in $D_{max}$ values. While applicant does not wish to be bound to any precise theory in explanation of the improved mordanting results observed in the case of the utilization of a copolymeric mordant hereof, an improved hydrophilic-hydrophobic balance and an enhanced affinity for image dyes may be involved.

The following examples are illustrative of the present invention and it will be understood that the invention is not limited thereto. All parts and percentages are by weight, except as otherwise indicated. In each of the EXAMPLES hereof, the vinylbenzyl trimethyl ammonium chloride monomer utilized in the polymerization was a mixture predominantly of para and meta isomers additionally containing a small content of ortho isomer. Accordingly, the molecular structure provided in the examples as indicative of the structure of recurring units from vinylbenzyl trimethyl ammonium chloride shows, for convenience, the positioning of the quaternary ammonium moiety without positional specificity to reflect the utilization of such a mixture of positional isomers.

EXAMPLE I

Into a 500-ml. round-bottomed, three-necked flask (equipped with a mechanical stirrer, thermometer and a refluxing condenser) were added 228 mls. of water. The reaction vessel containing the water was sparged with a flow of nitrogen and 34 gm. (0.2 mole) of diacetone acrylamide and 42 gms. (0.2 mole) of vinylbenzyl trimethyl ammonium chloride were added. The reaction vessel was again sparged with nitrogen and heated over a steam bath. Polymerization initiator (380 mgs. of a 0.5 wt. % solution of 4,4'-azobis(4-cyanovaleric acid) in water) was added and the polymerization was allowed to take place over a period of 16 hours. Acetone was added to the reaction vessel contents to effect precipitation of the copolymer and the copolymer was filtered, washed with acetone and dried to a white solid. The copolymer had the following structure:

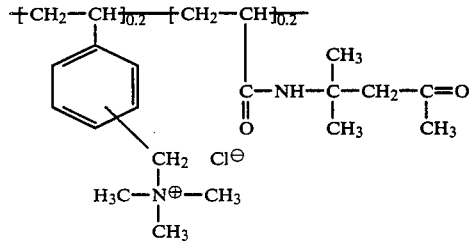

EXAMPLE II

An image-receiving element was prepared by coating a transparent four-mil (0.10 mm.) polyethylene terephthalate support with a 1:1 by weight mixture of poly(-vinylbenzyl trimethyl ammonium chloride-co-diacetone acrylamide), prepared as described in EXAMPLE I, and polyvinyl pyrrolidone (K-30, GAF Corporation). The mixture was coated at a coverage of about 300 mgs./ft.$^2$ (3229 mgs./m.$^2$). The image-receiving element was utilized in the production of a photographic diffusion transfer film unit as detailed hereinafter.

EXAMPLE III

A photographic film unit adapted to the provision of a permanent photographic laminate was prepared. The following cyan, magenta and yellow dye developers were utilized in the preparation of the multicolor photosensitive element:

cyan

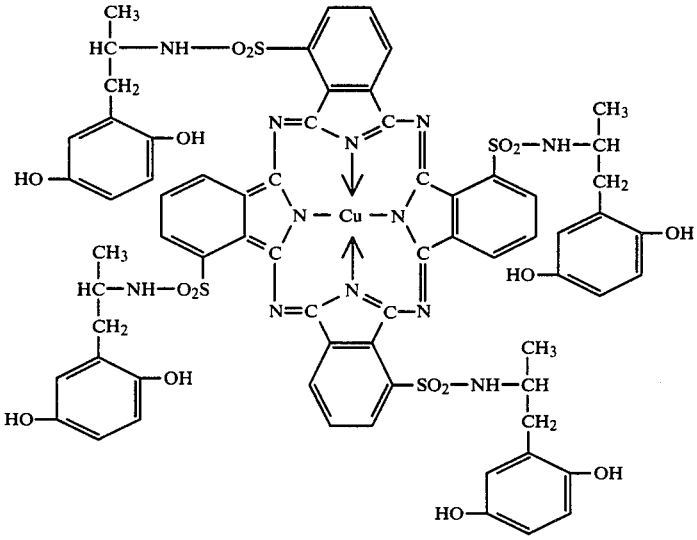

magenta

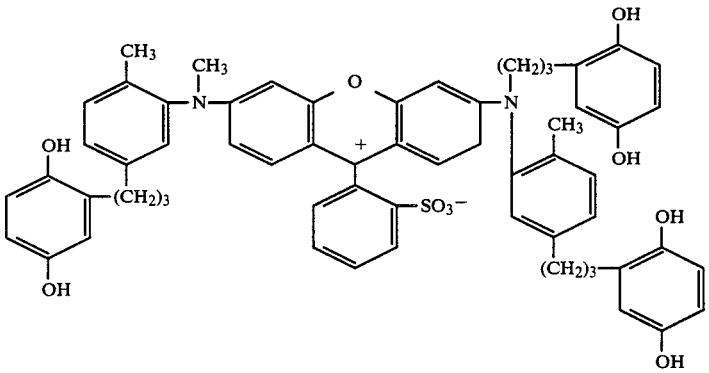

yellow

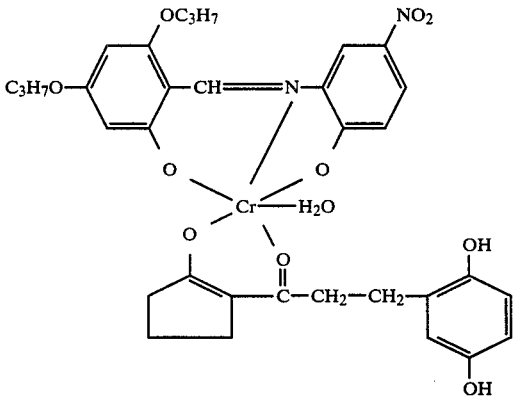

The multicolor photosensitive element was prepared by coating the following layers, in succession, onto an opaque subcoated polyethylene terephthalate film base:

1. as a polymeric acid layer approximately 9 parts of a ½ butyl ester of polyethylene/maleic anhydride copolymer and 1 part of polyvinyl butyral coated at a coverage of about 26,460 mgs./m.$^2$;

2. a timing layer coated at a coverage of about 3500 mgs./m.$^2$ of a 60/29/6/4/0.4 pentapolymer of butylacrylate, diacetone acrylamide, methacrylic acid, styrene and acrylic acid and about 52.5 mgs./m.$^2$ of gelatin;

3. a cyan dye developer layer comprising about 600 mgs./m.$^2$ of the cyan dye developer illustrated hereinbefore, about 400 mgs./m.$^2$ of gelatin, about 228 mgs./m.$^2$ of dodecylaminopurine and about 121 mgs./m.$^2$ of 4'-methylphenylhydroquinone;

4. a layer coated at a coverage of about 1000 mgs./m.$^2$ of titanium dioxide, about 375 mgs./m.$^2$ of a polymethylmethacrylate latex, about 125 mgs./m.$^2$ of gelatin and about 375 mgs./m.$^2$ of the pentapolymer described in layer 2;

5. a red-sensitive silver iodobromide emulsion layer comprising about 1300 mgs./m.$^2$ of silver and about 780 mgs./m.$^2$ of gelatin;

6. an interlayer comprising about 3000 mgs./m.$^2$ of a 60/30/4/6 tetrapolymer of butylacrylate, diacetone acrylamide, styrene and methacrylic acid and about 30 mgs./m.$^2$ of polyacrylamide;

7. a magenta dye developer layer comprising about 575 mgs./m.$^2$ of the magenta dye developer illustrated hereinbefore, about 288 mgs./m.$^2$ of gelatin and about 134 mgs./m.$^2$ of dodecylaminopurine.

8. a green-sensitive silver iodobromide emulsion layer comprising about 1400 mgs./m.$^2$ of silver and about 616 mgs./m.$^2$ of gelatin;

9. an interlayer comprising about 2500 mgs./m.$^2$ of the tetrapolymer described in layer 6, about 30 mgs./m.$^2$ of polyacrylamide and about 4 mgs./m.$^2$ of formaldehyde;

10. a layer comprising about 100 mgs./m.$^2$ of gelatin and about 250 mgs./m.$^2$ of dodecylaminopurine;

11. a yellow dye developer layer comprising about 500 mgs./m.$^2$ of the yellow dye developer illustrated hereinbefore and about 320 mgs./m.$^2$ of gelatin;

12. a layer comprising about 175 mgs./m.$^2$ of titanium dioxide, about 137.2 mgs./m.$^2$ of a polymethylmethacrylate latex and about 21.9 mgs./m.$^2$ of gelatin;

13. a blue-sensitive silver iodobromide emulsion layer coated at a coverage of about 950 mgs./m.$^2$ of silver and about 475 mgs./m.$^2$ of gelatin;

14. a layer comprising about 250 mgs./m.$^2$ of 4'-methylphenylhydroquinone and about 100 mgs./m.$^2$ of gelatin; and 15. a layer comprising about 484 mgs./m.$^2$ of gelatin.

The photosensitive element was photoexposed utilizing an exposure of 0.5 meter-candle-second through a standardized wedge target. Photographic processing was effected as follows. The photoexposed element was taped to one end of the image-receiving element (the image-receiving element of Example II) and a rupturable container (retaining an aqueous alkaline processing composition) was fixedly mounted at the leading edge of each of the elements, by pressure-sensitive tapes to make a film unit, so that, upon application of compressive force to the container to rupture the marginal seal of the container, the contents thereof would be distributed between the elements placed in face-to-face relationship, i.e., with their respective supports outermost.

The aqueous alkaline processing composition comprised the following components in the stated amounts.

| Components | Parts by Weight |
|---|---|
| Titanium dioxide | 2312 |
| Potassium hydroxide (45% by wt. in water) | 468 |
| Poly(diacetone acrylamide)oxime | 32 |
| Benzotriazole | 22 |
| 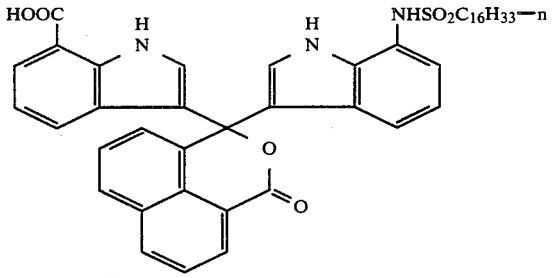 | 14 |
| 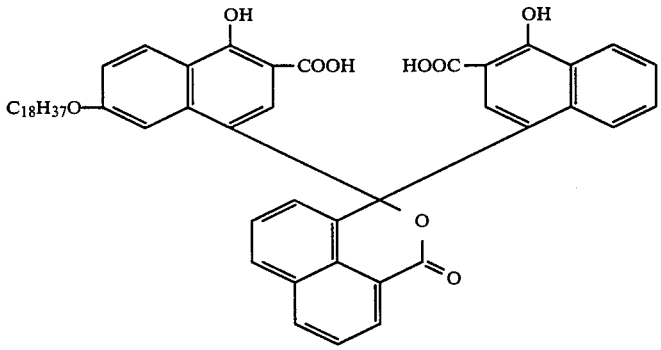 | 66.7 |

-continued

| Components | Parts by Weight |
|---|---|
| 1-(-hydroxyphenyl)-tetrazoline-5-thione | 1.9 |
| 6-methyluracil | 12 |
| N—hydroxyethyl-N,N',N'—triscarboxymethyl ethylene diamine | 30 |
| 6-bromo-5-methyl-4-azabenzimidazole | 4.8 |
| Colloidal silica (30% solids) | 37 |
| polyethylene glycol (M.W., approx. 4000) | 18 |
| N—phenethyl-α-picolinium bromide (50% by wt. in water) | 102 |
| 2-phenyl-benzimidazole | 4.8 |
| 2-methylimidazole | 33.3 |
| 4-amino-pyrazolo-(3,4d)pyrimidine | 5 |
| 6-oxypurine | 7.5 |
| Water | 1632 |

The processing composition was distributed between the elements of the film unit by passing the film unit between a pair of pressure-applying rolls having a gap of approximately 0.0030 inch (0.076 mm.). The resulting laminate was maintained intact to provide a multicolor integral negative-positive reflection print which exhibited good color quality.

EXAMPLE IV (CONTROL)

A control image-receiving element was prepared by coating a transparent four-mil polyethylene terephthalate support with a 1:1 by weight mixture of poly(vinylbenzyl trimethyl ammonium chloride) and polyvinyl pyrrolidone (K-30, GAF Corporation). The mixture was coated at a coverage of about 300 mgs./ft.$^2$ (3229 mgs./m.$^2$).

The control image-receiving element was utilized in the manner described in Example III for the provision of a photographic film unit. The film unit was processed in the manner described therein using a photosensitive element and a processing composition as described. Reflection density measurements were recorded at specified intervals following the spreading of the processing composition. Measurements were recorded in the maximum density ($D_{max}$) and minimum density ($D_{min}$) regions of the resulting photographic image and are set forth in the following TABLE I for purposes of comparison with the results obtained from the processing of the film unit of the invention described in Example III.

TABLE I

| Film Unit | | $D_{max}$ 1 min | $D_{max}$ 3 min | $D_{max}$ 5 min | $D_{max}$ 24 hrs | $D_{min}$ 1 min | $D_{min}$ 3 min | $D_{min}$ 5 min | $D_{min}$ 24 hrs |
|---|---|---|---|---|---|---|---|---|---|
| Example III | Red | 0.46 | 1.24 | 1.39 | 1.79 | 0.30 | 0.26 | 0.25 | 0.23 |
| | Green | 1.18 | 1.73 | 1.87 | 1.89 | 0.29 | 0.26 | 0.23 | 0.19 |
| | Blue | 1.65 | 1.75 | 1.69 | 1.30 | 0.27 | 0.24 | 0.21 | 0.17 |
| Control | Red | 0.46 | | 0.70 | 1.17 | 0.30 | | 0.24 | 0.24 |
| | Green | 0.87 | | 1.35 | 1.51 | 0.29 | | 0.23 | 0.21 |
| | Blue | 1.49 | | 1.38 | 1.06 | 0.28 | | 0.20 | 0.18 |

From inspection of the data set forth in TABLE I, it will be seen that a film unit of the invention including a layer of a copolymeric mordant of the invention, i.e., poly(vinylbenzyltrimethyl ammonium chloride-co-diacetone acrylamide), provided greater maximum density values and at a more rapid rate than the control film unit utilizing the homopolymeric mordant, poly(vinylbenzyltrimethyl ammonium chloride).

What is claimed is:

1. An image-receiving element which comprises a support carrying an image-receiving layer comprising a copolymeric mordant having recurring units according to the formula

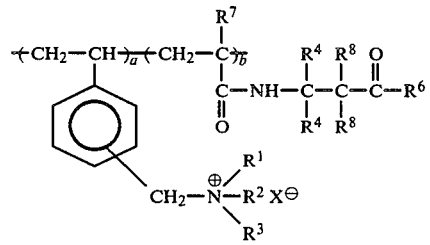

wherein each of $R^1$, $R^2$ and $R^3$ is methyl; $X\ominus$ is an anion; each $R^4$ is methyl; $R^6$ is alkyl of from 1 to 4 carbon atoms; $R^7$ is hydrogen; each $R^8$ is hydrogen and wherein the molar ratio of the respective recurring units represented by integers a and b is in the range of from about 0.3:1 to about 3:1.

2. The image-receiving element of claim 1 wherein in said copolymeric mordant $X\ominus$ is halide.

3. The image-receiving element of claim 2 wherein $X\ominus$ is chloride.

4. The image-receiving element of claim 1 wherein said image-receiving layer comprises a mixture of said copolymeric mordant and a hydrophilic polymer.

5. The image-receiving element of claim 4 wherein said hydrophilic polymer comprises polyvinyl pyrrolidone.

6. The image-receiving element of claim 4 wherein the ratio by weight of said polyvinyl pyrrolidone to said copolymer mordant is about 0.3:1 to about 3:1.

7. The image receiving element of claim 1 wherein between said image-receiving layer and said support there is present a polymeric acid-reacting layer and a polymeric timing layer through which alkali may diffuse to said polymeric acid-reacting layer, said polymeric acid-reacting layer being contiguous to said support.

8. The image-receiving element of claim 7 wherein said support comprises an opaque paper support.

9. The image-receiving element of claim 1 wherein $R^6$ is methyl.

10. The image-receiving element of claim 9 wherein the molar ratio of a:b is about 1:1.

11. A diffusion transfer film unit which comprises a photosensitive system comprising at least one photosensitive silver halide emulsion layer having associated therewith a diffusion transfer process image dye-providing material and an image-receiving layer adapted to receive an image dye-providing material after photoexposure and processing, said image-receiving layer comprising a copolymeric mordant having recurring units according to the formula

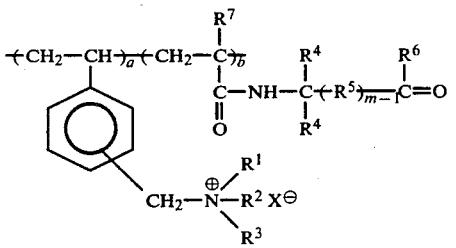

wherein each of $R^1$, $R^2$ and $R^3$ is alkyl; $X\ominus$ is an anion; each $R^4$ is methyl or ethyl; $R^5$ is methylene; $R^6$ is alkyl of from 1 to 4 carbon atoms; $R^7$ is hydrogen; m is the integer 2; and wherein the molar ratio of the respective recurring units represented by integers a and b is in the range of from about 0.1:1 to about 10:1.

12. The diffusion transfer film unit of claim 11 wherein said unit is an integral negative-positive film unit which comprises:

a photosensitive element comprising a composite structure containing, as essential layers, in sequence, an opaque layer, said photosensitive system, said image-receiving layer, and a transparent layer; and means retaining an aqueous alkaline processing composition integrated with said film unit so that said processing composition can be distributed between said photosensitive system and said image-receiving layer, said processing composition providing a light-reflecting pigment such that the distribution of said processing composition between said photosesensitive system and said image-receiving layer provides a light-reflecting layer against which a dye image formed in said image-receiving layer can be viewed.

13. The diffusion transfer film unit of claim 11 wherein said unit is an integral negative-positive film unit which comprises:

a photosensitive element comprising, as essential layers, in sequence, a transparent layer, said image-receiving layer, a processing composition permeable light-reflecting layer against which a dye image formed in said image-receiving layer can be viewed, and said photosensitive system;

a transparent sheet superposed substantially coextensive the surface of said photosensitive element opposite said transparent layer; and means retaining an aqueous alkaline processing composition, which includes an opacifying agent, integrated with said film unit such that said processing composition can be distributed between said photosensitive system and said transparent sheet.

14. The diffusion transfer film unit of claim 11 wherein the molar ratio of a:b in said mordant copolymer is in the range of from about 0.3:1 to about 3:1.

15. The diffusion transfer film unit of claim 14 wherein said image-receiving layer comprises a mixture of said copolymeric mordant and a hydrophilic polymer.

16. The diffusion transfer film unit of claim 15 wherein said hydrophilic polymer comprises polyvinyl pyrrolidone.

17. The diffusion transfer film unit of claim 16 wherein the ratio by weight of said polyvinyl pyrrolidone to said copolymeric mordant is about 0.3:1 to about 3:1.

18. The diffusion transfer film unit of claim 11 wherein $R^6$ is methyl.

19. An integral negative-positive diffusion transfer film unit which comprises in a superposed fixed relationship before and after photoexposure:

a photosensitive element comprising an opaque support carrying a plurality of layers including at least one photosensitive silver halide layer having associated therewith a diffusion transfer process image dye-providing material; and an image-receiving element comprising a transparent support carrying an image-receiving layer adapted to receive said image dye-providing material after photoexposure and processing, said image-receiving layer comprising a copolymeric mordant having recurring units according to the formula

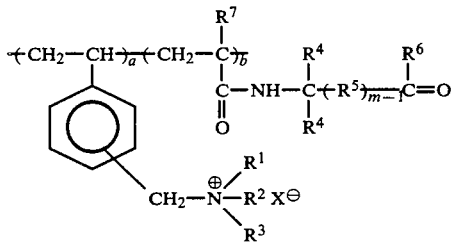

wherein each of $R^1$, $R^2$ and $R^3$ is alkyl; $X\ominus$ is an anion; each $R^4$ is methyl or ethyl; $R^5$ is methylene; $R^6$ is alkyl of from 1 to 4 carbon atoms; $R^7$ is hydrogen; m is the integer 2; and wherein the molar ratio of the respective recurring units represented by integers a and b is in the range of from about 0.1:1 to about 10:1;

a rupturable container releasably holding an aqueous alkaline processing composition including a light-reflecting pigment;

said rupturable container being positioned transverse the leading edge of said film unit so as to release said processing composition for distribution between said elements after photoexposure to provide a light-reflecting layer against which a dye image formed in said image-receiving layer may be viewed through said transparent support without separation of said superposed photosensitive and image-receiving elements.

20. The diffusion transfer film unit of claim 19 wherein $X\ominus$ is chloride.

21. The diffusion transfer film unit of claim 19 wherein each of $R^1$, $R^2$ and $R^3$ of said copolymeric mordant is methyl and X is chloride.

22. The diffusion transfer film unit of claim 19 wherein said image-receiving layer comprises a mixture of said copolymeric mordant and a hydrophilic polymer.

23. The diffusion transfer film unit of claim 22 wherein said hydrophilic polymer comprises polyvinyl pyrrolidone.

24. The diffusion transfer film unit of claim 23 wherein the ratio by weight of said polyvinyl pyrrolidone to said copolymeric mordant is about 0.3:1 to about 3:1.

25. The diffusion transfer film unit of claim 19 wherein $R^6$ is methyl.

26. A diffusion transfer film unit which comprises, in combination:

a photosensitive element comprising an opaque support carrying a plurality of layers including at least one photosensitive silver halide layer, having associated therewith a diffusion transfer process image dye-providing material; and an image-receiving element comprising a support carrying a polymeric acid-reacting layer; a polymeric timing layer through which alkali may diffuse to said polymeric acid-reacting layer; and an image-receiving layer comprising a mixture of a hydrophilic polymer and a copolymeric mordant in a weight ratio of said hydrophilic polymer to said copolymeric mordant of about 0.3:1 to about 3:1, said copolymeric mordant having recurring units according to the formula

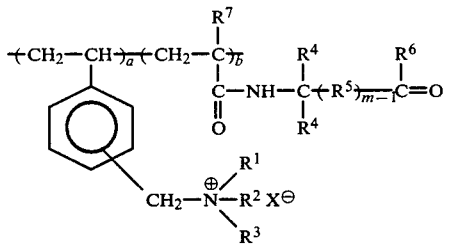

wherein each of $R^1$, $R^2$ and $R^3$ is alkyl; $X\ominus$ is an anion; each $R^4$ is methyl or ethyl; $R^5$ is methylene; $R^6$ is methyl; $R^7$ is hydrogen; m is the integer 2; and wherein the molar ratio of the respective recurring units represented by integers a and b is in the range of from about 0.3:1 to about 3:1;

means providing an aqueous alkaline processing composition for initiating development of silver halide emulsion after photoexposure to form thereby an imagewise distribution of mobile dye developer which is transferred, at least in part, to said image-receiving layer to impart thereto a dye image;

said image-receiving element being adapted for separation from contact with said processing composition subsequent to the formation of said dye image.

27. The diffusion transfer unit of claim 26 wherein said support of said image-receiving element comprises an opaque paper support.

28. The diffusion transfer film unit of claim 26 wherein said hydrophilic polymer comprises polyvinyl pyrrolidone.

29. The diffusion transfer film unit of claim 26 wherein $X\ominus$ is halide.

30. The diffusion transfer film unit of claim 29 wherein each of $R^1$, $R^2$ and $R^3$ of said copolymeric mordant is methyl and X is chloride.

31. The diffusion transfer film unit of claim 26 wherein each $R^4$ is methyl.

32. A process for forming a diffusion transfer image which comprises, in combination, the steps of exposing a photosensitive system comprising at least one photosensitive silver halide emulsion layer having associated therewith a diffusion transfer image dye-providing material; contacting said exposed photosensitive system with an aqueous alkaline processing composition effecting thereby development of said silver halide emulsion(s) and the formation of an imagewise distribution of diffusible image dye-providing material; transferring, by imbibition, at least a portion of said imagewise distribution of diffusible image dye-providing material to a superposed image-receiving layer comprising a copolymeric mordant having recurring units according to the formula

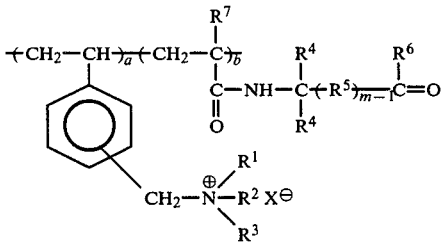

wherein each of $R^1$, $R^2$ and $R^3$ is alkyl; $X\ominus$ is an anion; each $R^4$ is methyl or ethyl; $R^5$ is methylene; $R^6$ is alkyl of from 1 to 4 carbon atoms; $R^7$ is hydrogen; m is the integer 2; and wherein the molar ratio of the respective recurring units represented by integers a and b is in the range of from about 0.3:1 to about 3:1.

33. The process of claim 32 wherein $X\ominus$ is halide.

34. The process of claim 32 wherein each of $R^1$, $R^2$ and $R^3$ is methyl and X is chloride.

35. The process of claim 32 wherein $R^6$ is methyl.

36. The image-receiving element of claim 1 wherein said copolymeric mordant consists essentially of said recurring units.

37. The diffusion transfer film unit of claim 11 wherein said copolymeric mordant consists essentially of said recurring units.

38. The integral negative-positive diffusion transfer film unit of claim 19 wherein said copolymeric mordant consists essentially of said recurring units.

39. The diffusion transfer film unit of claim 26 wherein said copolymeric mordant consists essentially of said recurring units.

40. The process of claim 32 wherein said copolymeric mordant consists essentially of said recurring units.

* * * * *